US007568356B2

(12) United States Patent
Hillberg

(10) Patent No.: US 7,568,356 B2
(45) Date of Patent: Aug. 4, 2009

(54) METHOD AND DEVICE FOR TRANSFERRING WATER FROM A SOURCE TO A CONSUMER

(75) Inventor: Arne Hillberg, Gävle (SE)

(73) Assignee: Hillberg Innovation AN, Gävle (SE)

( * ) Notice: Subject to any disclaimer, the term of this patent is extended or adjusted under 35 U.S.C. 154(b) by 927 days.

(21) Appl. No.: 10/711,020

(22) Filed: Aug. 18, 2004

(65) Prior Publication Data

US 2006/0040018 A1 Feb. 23, 2006

(51) Int. Cl.
*F25E 17/02* (2006.01)
*B60H 1/32* (2006.01)

(52) U.S. Cl. ..... 62/98; 62/239; 62/338; 62/389

(58) Field of Classification Search ..... 62/239, 62/337–339, 389–390, 457.3, 98
See application file for complete search history.

(56) References Cited

U.S. PATENT DOCUMENTS

| | | | | |
|---|---|---|---|---|
| 2,461,197 | A * | 2/1949 | Chambers | 62/239 |
| 3,250,433 | A * | 5/1966 | Christine et al. | 222/131 |
| 3,699,776 | A | 10/1972 | La Raus | |
| 4,599,166 | A | 7/1986 | Gesslauer | |
| 5,349,992 | A * | 9/1994 | Gallo et al. | 141/18 |
| 5,542,265 | A * | 8/1996 | Rutland | 62/389 |
| 5,584,188 | A * | 12/1996 | Tippmann et al. | 62/239 |
| 6,282,909 | B1 * | 9/2001 | Newman et al. | 62/74 |
| 7,076,966 | B2 * | 7/2006 | Mullen | 62/337 |

FOREIGN PATENT DOCUMENTS

| | | |
|---|---|---|
| DE | 23 54 422 | 5/1975 |
| GB | 2 278 388 A | 11/1994 |
| SE | 0200494-3 | 8/2003 |

* cited by examiner

*Primary Examiner*—William E Tapolcai
(74) *Attorney, Agent, or Firm*—Albihns AB

(57) ABSTRACT

A system and method for transferring or transporting water from a water source to a consumer can be used and performed while maintaining water quality. Containers housing or transporting the water maintain the water in an essentially liquid state at a low temperature. Consumers are connected to the water supply through taps in a larger system.

25 Claims, 2 Drawing Sheets

METHOD AND DEVICE FOR TRANSFERRING WATER FROM A SOURCE TO A CONSUMER

BACKGROUND OF INVENTION

1. Field of the Invention

The present invention relates generally to the distribution and dispensing of water. More specifically, the invention relates to methods and devices for transferring or distributing water from a water source to a consumer while preserving water quality.

2. Background of the Invention

Transferring high quality water from a source to consumers in a way that preserves the quality and taste of the water is a necessary process in many parts of the world. In areas of water demand where there is a lack of local water, or that water is scarce or polluted, transporting water is the only solution to meet the demand. Numerous methods and devices exist to meet water demand.

For example, water can be frozen and transported in solid form. This, however, has a negative impact on the taste of the supplied water. This is believed to be at least in part due to the separation of salts from the water during freezing. The salts, calcium, magnesium and other components sink to lower levels in the water volume, meaning the water does not contain optimum levels of these components.

Bottles or other packaging can be employed, however, they can be mishandled, such as through exposure to heat, which deteriorates the taste and quality of the water. Existing methods and devices sacrifice taste and quality for ease of transport. That is not to suggest that freezing and packaging water creates for superior transportability, as handling large blocks of ice has inherent challenges and risks. However, they also introduce unnecessary risks of contamination through handling and processing.

German Patent Application No. 1973002354422 discloses transport of water from a source to a consumer by freezing water. This results in decreased quality and incurs all the technical problems of handling ice.

U.S. Pat. No. 5,349,992 teaches the circulation and cooling of transported water can take place immediately before supplying the water to the consumer. U.S. Pat. No. 4,599,166 also relates to circulating and cooling water at the location of the consumer. Both of these patents are related to solving related but different problems in water distribution, while failing to address the present need to provide method and devices for improved distribution of water from a source to a consumer while maintaining water quality and taste.

U.S. Pat. No. 3,699,776 addresses the challenge of removing pollutants from transported drinking water, however, it also fails to address the unique challenges designed to be met by the present invention.

British Patent Publication 2,278,388 discusses solutions to the problem of recycling and treating waste water, which again is a contribution to the art but not a solution to the present problem.

SUMMARY OF INVENTION

The present invention addresses the problems noted above in a novel way. Although the individual components of the invention may be assembled from existing materials, the methods and devices created thereby are novel improvements on the state of the art. The inventive method and device are free from the problems associated with previous systems which rely on ice and packaging such as bottles.

The invention relates to drawing water from one or more sources and delivering that water, at the same quality level, to consumers. In particular, pure mineral and spring water can be delivered to final consumers.

Water can be pumped and tapped from a spring or well using a conventional pump house. The water can be transported to a treatment facility where chemicals such as preservatives and flavourings are blended in the water. The treated water can then be packaged in bottles or containers made of, for example, plastic, glass, treated paper (as in TETRAPAK) and PET. Typically, the packaged water is held at room temperature and eventually transported to some sort of warehouse for storage. From the storage facility, the bottles or containers are further transported to a store, restaurant or other purchaser, again typically at uncontrolled temperature. Final customers then receive the packaged water and, in many cases, transport it themselves to their home. The packaging, such as plastic bottles, then needs to be further transported after the water is consumed for disposal or recycling.

The current methods and devices for water transport are therefore unnecessarily complicated, and yield an unsatisfactory product. A further side effect is the high cost of such processes. Not only are all the steps and materials expensive, they can result in injuries to personnel, such as through repeated lifting of heavy water bottles. The loss in quality bears not only on the desirability of the final product; it also impacts the potential degree of consumption of water. Research has shown that consumption is the only route for taking water into the human body, whereas the lungs, skin, kidneys and digestive system all remove water from the body. Regular and sufficient intake of clean, non-chlorinated water aids in balancing water loss, and has been demonstrated to reduce illness. The present invention addresses this beneficial goal.

According to a first embodiment of the present invention, a method for supplying water from a water source to a consumer is provided, which comprises transferring the water from the source to a container proximal to the source, bringing the water to or maintaining the water at approximately 0° C. in the container, moving at least some of the approximately 0° C. water to a transport unit, and transporting the approximately 0° C. water to a water circulation and temperature retaining system. At least one tap device is provided on the water circulation and temperature retaining system which tap device can be accessed by the consumer. The supplied water is of approximately the same quality as the water in the water source. The moving and transporting are done in such a way that the water is maintained at approximately 0° C. while a majority of the water remains in the liquid state.

According to a further embodiment, the transport unit can be a closed system such as a tanker truck or a pipe. The tap device can be a faucet. A pump or tap can be used to withdraw the water from the source. Multiple containers or transport units can be employed.

According to a further embodiment, a system for supplying water from a water source to a consumer is provided, which comprises a tapping or pumping device located in proximity to a water source, a storage container is connected to the tapping or pumping device so that tapped or pumped water may be stored therein and comprising a temperature adjustment and maintaining system capable of bringing the water stored therein to or maintaining the water stored therein at approximately 0° C., a transport container is arranged to be connectable to the storage container so that stored water may be transferred thereto, an internally-closed water circulation system arranged to be connectable to said transport container, a consumer-accessible water tapping device in fluid connection with the water circulation system, and a temperature retaining system provided within or in communication with the water circulation system and capable of maintaining water at approximately 0° C. The supplied water is of approximately the same quality as the water in the water source and a majority of the water in the liquid state while in the system.

According to a further embodiment, the storage container can comprise multiple containers. The transport container can be a tanker truck; both the storage container and the transport container may be closed systems. The water tapping device may be a faucet. Surfaces contacting the water may comprise essentially inert material. The present system may be employed where the source and consumer are in close proximity, such as 1 mile, 2 miles, 5 miles, 10 miles, or 50 miles, or at a longer distance such as 100 miles, 500 miles, 1,000 miles or 2,000 miles. The source and consumer may preferably be located between 1 and 200 miles apart. Arrangements may be made so that a water temperature of approximately 0° C. is maintained throughout the system; this may be done through water circulation. The pumping device may comprise a pump house.

According to a further embodiment, a water quality analysis device is provided in communication with the transport container. Additionally, a cooling device can be provided in fluid connection to the water in the water circulation system. There may be further provided a coordination device capable of coordinating activities of the pumping or tapping device, the container, the transport device, and the water circulation system. The water circulation system may be capable of ordering the water from at least one of the pumping or tapping device, the container, and the transport device. This ordering may be executable using the international telephone network, e.g., the internet. A debiting system may be provided in conjunction with at least one of the pumping or tapping device, the container, the transport device, and the water circulation system.

According to a further embodiment, the consumer may be able to choose between multiple water sources and multiple transport systems. Alternatively or in addition, a water circulation system can communicate supply requirements with at least one of the pumping or tapping device, the container, and the transport device. The consumer(s) can be debited by at least one of the pumping or tapping device, the container, the transport device, and the water circulation system for the water the consumer(s) utilize.

The invention can be viewed as comprising three main components: a first part which pumps the water from the source to the storage container, a second part which transports the water, and a third part which circulates the water to consumers. An optional fourth part can be configured as a control device interrelated to the first three parts. It can comprise an ordering system, whereby water is directly or indirectly ordered and distributed to a consumer according to certain requirements. It can also comprise a billing or debiting system where the amount of water used by a particular consumer can be calculated based on the removal of water from any stage of the system or method. Alternatively, the first, second or third parts can directly calculate use and debit the consumer.

One way the invention can function is if the fourth part can contact any of the first, second, or third parts regarding supply, and based on that contact direct the other parts to act in a certain way. Where multiple sources or transport units are available, the system or method may be configured so that the consumer may choose which source or transport unit is used.

Certain benefits of the invention are clear from the outset. Households which otherwise do not have direct access to potable water can receive high quality water without chemical additives and without resorting to self-transport. The invention provides systems and methods to create a closed system directly from the water source to the sink faucet in the consumer's home. A simple electric flow meter can measure use and be located in the cellar, kitchen, or other central location in the house. The system or method can employ leasing or purchase of components and/or water.

Owners of housing facilities can increase the attractiveness of their property through providing high quality drinking water to their residents. Optionally, the system could be included in the original construction. The present invention relies on certain commercially-available materials such as non-reactive or inert tubing and piping which can be used in the novel systems and methods to provide clean, bacteria-free, odour-free, colourless water to consumers. This is also beneficial where water low in heavy metals, salt, or other additives or contaminants so that the water can be consumed in large amounts without contributing to the daily intake of these materials.

Through the use of the present invention, water can be provided even where the consumer lacks proximity to a good water source. Based on the straightforward construction possible with the invention, low building costs and economic distribution can be met.

DETAILED DESCRIPTION

The present invention is herein described based on reference to particular embodiments.

Figure 1:
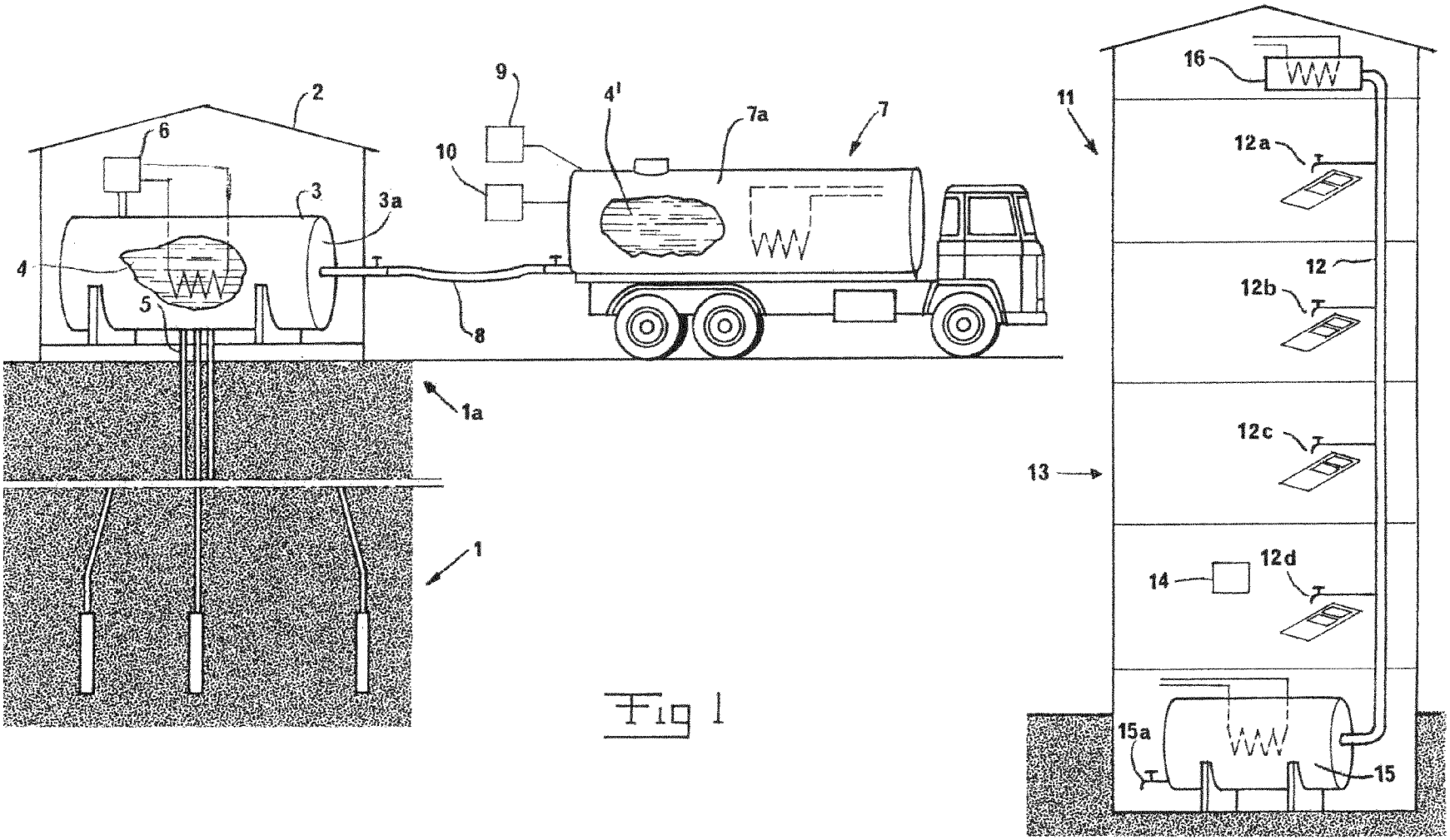
FIG. 1 is a schematic diagram of a system according to the present invention.

FIG. 1 shows a water source 1, such as spring water. The source can comprise or contain a bored hole which leads to a water artery or route leading to the surface. Depending on the terrain and source, the holes can be of various depths, such as 100 yards. Preferably, the water source provides high quality water. At the upper end of the holes 1*a* a pump house 2 is situated, which can be of any type known in the art. Pump house 2 contains a water tank 3 as known in the art. Water tank 3 has an internal space 3*a* holding the pumped water 4. The pumping and storage can comprise a closed system as shown in the figure, symbolized with reference numeral 5. Filtering may be done in conjunction with this stage. Water 4 will naturally be of a low temperature. Pump house 2 or water tank 3 can be provided with or connected to a cooling system or agent which can maintain the low water temperature or reduce the water temperature to a desired level. According to the present invention, water 4 is preferably maintained at approximately 0° C., which can be effectuated through a cooling unit 6.

From container 3 water 4 can be transferred to a transport unit 7 which preferably is a tanker truck having a tank 7*a*. Water 4 is transferred to transport unit 7 via a removable connection 8 which, in the present example, forms a closed system. The water 4' in transport unit 7 can be analysed using an analyser 9. Preferably, transport unit 7 can maintain the temperature of water 4'. A cooling unit 10 may be employed for this purpose.

Transport unit 7 transports water 4' a distance to a series of consumers 11. The system comprises a pipe system 12 which preferably circulates water. Pipe system 12 comprises a series of taps 12*a*, 12*b*, 12*c*, 12*d*. Consumers can be located in an apartment building 13, a consumer being represented as 14. Pipe system 12 is preferably provided with insulation to maintain temperature and protect against condensation. A cold storage 15 is connected to pipe system 12 as is a cooling device 16, which may preferably be located on the top floor of apartment building 13. Thus, the low water temperature may be maintained. A cold storage tap 15*a* is provided for drainage, cleaning and other servicing.

Figure 2:
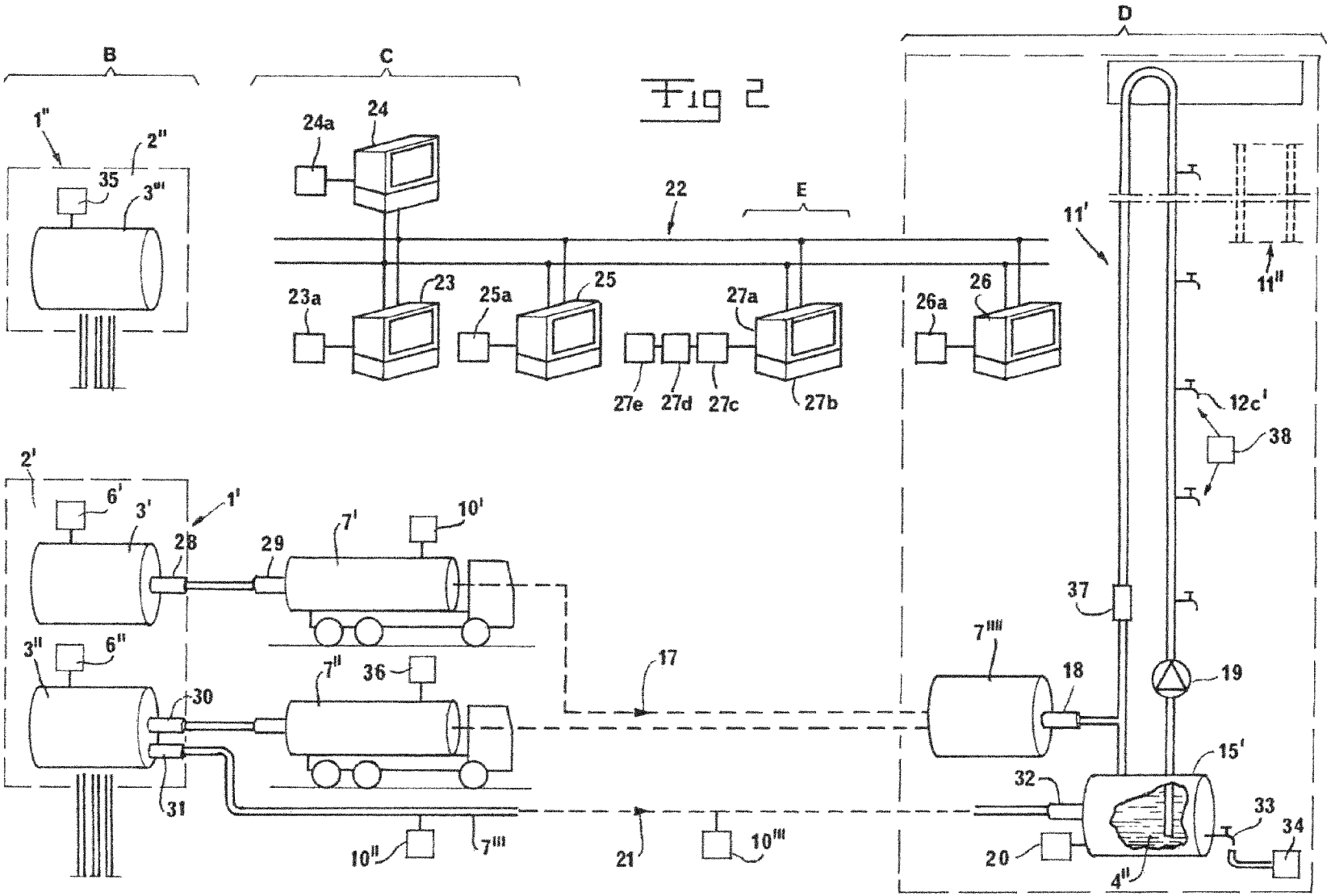
FIG. 2 is a schematic diagram of a system according to the present invention

FIG. 2 shows how, according to the present invention, a series of water sources can be utilized 1". Each source can be connected to one or multiple pump houses 2'. Each pump house could contain multiple containers 3', 3", 3'". Container 3', 3", 3'" can have a separate cooling arrangement 6', 6" or a shared system. Two or more transport units 7', 7" can be used, transport also being effected by a pipe transporter 7'".

In FIG. 2, the cooling arrangement for transport unit 7' is 10'. Alternatively, pipe transporter 7'" can directly connect to or comprise a cooling arrangement 10", 10'". The water is transported to one or more pipe systems 11', 11". Transport of the water may be on a direct path 17 where a transport wagon 7"" is deposited and/or linked with an arrangement 18 to pipe system 11". Storage of the water and transferring can be effected by known methods. Preferably, a pump 19 is provided within pipe system 11' which circulates the water 4". In this figure, a cooling unit 20 is provided. The supply and refill of water 4" can be performed as known in the art, preferably with a direct connection forming a closed system.

The initial source and storage B can be configured in a number of ways. Likewise, the transport C can be provided in a number of ways. Distribution D can comprise multiple series of systems and multiple users. As shown in FIG. 2, the system according to the present invention is flexible and adaptable to particular needs. A communication system E can be provided to improve ease of communication between units B, C, D. The internet 22 can be used in system E. Unit B can connect to system E through a device as shown in 23, 24. Unit C, transport, can communicate through device 25. Alternatively, D and E can communicate using 26 and 27, respectively. The communication can be effected through a computer terminal 27*a*, 27*b*. This can include various functions such as ordering, debiting, where a debiting function 26*a* is shown in relation to device 26. Devices 23, 24, and 25 are provided with arrangements 23*a*, 24*a*, 25*a*, respectively for ordering and debiting via internet 22. Device 27 is provided with a request receiving device 27*c* as well as a choice of source, transport unit and distribution system device 27*d* and a debiting device 27*e*.

Unit E can therefore comprise a central unite of the system, whereby various parts communicate demands and status in conjunction with water ordering, choice of suppliers and transporters, etc. Unit E can also handle measuring and debiting functions in conjunction with water distribution.

The water supplied herein should retain its' quality, for example, the original consistence and taste, while being handled and cooled/kept cool as described herein. The connections 28, 29, 30, 31, and 32 are provided. It is possible to provide information to consumers via the internet on choices and supply status by unit E. The supplied unit D can enter into an agreement for water supply with unit E through internet 22 or a conventional way. The debitering device 27*e* can effect debiting of unit D by unit E. Qualities of the water stored in unit B can be displayed as can transport options from unit C. Units D and/or E can order water and services from units B and C, and unite C can debit unit E for the supplied water via debiting devices 23*a*, 24*a*, 25*a*. Units D and E can pay for the water through their debiting devices 26*a*, 27*a* or through conventional means.

Clearly, there can be multiple units E, unit D being able to select the most favourable unit E based on price, quality, delivery time, or other criteria. Similarly can they choose between multiple units B and C. This complex network of communications and options can provide the consumer with a multitude of choices regarding how to obtain high quality, additive-free water. Preferably, the entire system is designed for ease of cleaning and maintenance, for example by providing drainage taps. Such a tap 33 is shown in FIG. 2, where is also provided a general overflow or collection bin 34. Cleaning unite 35 and 36 demonstrate how the entire system of the present invention can be easily maintainable according to known methods.

As noted previously, insulation 37 may be provided on pipe system 11' such as FUSIOTHERM to prevent condensation outside the pipes in, for example, an apartment building. Known materials include a middle layer with a blend of PP-R-80 and glass fibres. All the piping and connections can be made of FUSIOTHERM PP-piping which does not release contaminants such as heavy metals. Ideally, in all the components with a surface in contact with water, inert materials are employed. In this way, according to the present invention, water may be transported directly from a source to a consumer without loss of quality. The invention makes possible an improved and less expensive distribution system. It also can reduce the use or reliance upon undesirable water sources, e.g. water having bacteria, fluoride, radon, sodium, etc. as well as water that is undesirably hard, soft, sour, etc. A flow meter 38 can distribute and measure water.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof. Patent applications and patents cited herein indicate the knowledge in this field and are hereby incorporated by reference in their entirety. Where inconsistent interpretations are possible, the disclosure herein controls.

The invention claimed is:

1. A method for supplying water from a water source to a consumer, comprising:

transferring the water from the source to a container proximal to the source;

bringing the water to or maintaining the water at approximately 0° C. in said container;

moving at least some of the approximately 0° C. water to a transport unit; and transporting the approximately 0° C. water by means of the transport unit to a pipe system comprising a water circulation and temperature retaining system, wherein at least one consumer accessible tap device is provided on said water circulation and temperature retaining system;

the supplied water being of approximately the same quality as the water in the water source; and said moving and transporting steps are provided so that the water is maintained at approximately 0° C. while keeping a majority of the water in the liquid state.

2. A method according to claim 1, wherein said transport unit is a closed system.

3. A method according to claim 1, wherein said transport unit is a tanker truck or a pipe.

4. A method according to claim 1, wherein said tap device is a faucet.

5. A method according to claim 1, wherein the water in said container is below 0° C.

6. A method according to claim 1, wherein said transfer is performed by at least one pump or tap; and said transporting is performed by at least one transport container.

7. A system for supplying water from a water source to a consumer, comprising:

a tapping or pumping device located in proximity to a water source;

a storage container connected to said tapping or pumping device so that tapped or pumped water may be transferred to and stored in said storage container which comprises a temperature adjustment and maintaining system capable of bringing the water stored therein to or maintaining the water stored therein at approximately 0° C.;

a transport container arranged to be connectable to said storage container so that stored water may be transferred thereto;

an internally-closed pipe system comprising water circulation system arranged to be connectable to said transport container;

a consumer-accessible water tapping device in fluid connection with said pipe system comprising water circulation system; and a temperature retaining system provided within or in communication with said pipe system comprising water circulation system and capable of maintaining water at approximately 0° C.; wherein the supplied water is of approximately the same quality as the water in the water source; and a majority of the water in the liquid state.

8. A system according to claim 7, wherein said storage container comprises at least two containers.

9. A system according to claim 7, wherein said transport container is a tanker truck.

10. A system according to claim 7, wherein a connection connecting said storage container and said transport container is a closed system.

11. A system according to claim 7, wherein a connection connecting said transport container and said pipe system comprising water circulation system is a closed system.

12. A system according to claim 7, wherein said water tapping device is a faucet.

13. A system according to claim 7, wherein surfaces in contact with the water comprise essentially inert material.

14. A system according to claim 7, wherein said water source and is located at a distance of one to 200 miles from said consumer.

15. A system according to claim 7, wherein at least one of said storage container, said transport container, and said pipe system comprising water circulation system are arranged so that a water temperature of approximately 0° C. is maintainable therein through circulation.

16. A system according to claim 7, wherein said pumping device comprises a pump house.

17. A system according to claim 7, further comprising a water quality analysis device in communication with said transport container.

18. A system according to claim 7, further comprising a cooling device in fluid connection to the water in said pipe system comprising water circulation system.

19. A system according to claim 7, wherein said pumping or tapping device pumps or taps water from said water source to said container;

said container receives the water and transfers the water to said transport system;

said transport system receives the water and transports the water to said pipe system comprising water circulation system; and said pipe system comprising water circulation system distributes the water to a consumer.

20. A system according to claim 19, further comprising a coordination device, wherein said coordination device is capable of coordinating activities of said pumping or tapping device, said container, said transport device, and said pipe system comprising water circulation system.

21. A system according to claim 19, wherein said pipe system comprising water circulation system is capable of ordering the water from at least one of said pumping or tapping device, said container, and said transport device.

22. A system according to claim 21, wherein said ordering is executable using the international telephone network, said international telephone network comprising the world wide web.

23. A system according to claim 19, further comprising a debiting system provided in conjunction with at least one of said pumping or tapping device, said container, said transport device, and said pipe system comprising water circulation system.

24. A system according to claim 19, wherein the consumer may select between at least two water sources and at least two transport systems.

25. A system according to claim 19, wherein said pipe system comprising water circulation system communicates supply requirements with at least one of said pumping or tapping device, said container, and said transport device; and the consumer or a series of consumers are debited by at least one of said pumping or tapping device, said container, said transport device, and said pipe system comprising water circulation system for the water the consumer or said series of consumers consumes.

* * * * *